US005556548A

United States Patent [19]

Mellen

[11] Patent Number: 5,556,548

[45] Date of Patent: Sep. 17, 1996

[54] PROCESS FOR CONTAMINATED OIL RECLAMATION

[75] Inventor: Craig R. Mellen, Salt Lake City, Utah

[73] Assignee: Interline Hydrocarbon Inc., Casper, Wyo.

[21] Appl. No.: 197,473

[22] Filed: Feb. 15, 1994

Related U.S. Application Data

[62] Division of Ser. No. 522,642, May 14, 1990, Pat. No. 5,286,380.

[51] Int. Cl.[6] ..... B01D 36/00; B01D 17/09; B01D 1/02

[52] U.S. Cl. ..... 210/806; 208/179; 208/180; 208/181; 208/182; 210/688; 210/728; 210/729; 210/737; 210/767; 210/774; 210/800; 210/807

[58] Field of Search ..... 210/648, 690, 210/694, 728, 729, 767, 770, 774, 800, 806, 807, 688, 737; 208/179, 180, 181, 182

[56] References Cited

U.S. PATENT DOCUMENTS

| | | | |
|---|---|---|---|
| 2,070,626 | 2/1937 | Shoemaker | 208/180 |
| 2,196,989 | 4/1940 | Henry et al. | 208/309 |
| 3,870,625 | 3/1975 | Wielezynski | 208/180 |
| 4,169,044 | 9/1979 | Crowley | 208/181 |
| 4,265,734 | 5/1981 | Wielezynski | 208/180 |
| 4,512,878 | 4/1985 | Reid et al. | 208/179 |
| 4,977,871 | 12/1990 | Brownawell et al. | 208/182 |

*Primary Examiner*—John Kim

*Attorney, Agent, or Firm*—Van Cott, Bagley, Cornwall & McCarthy

[57] ABSTRACT

A novel process and related apparatus for removing common contaminants from used motor oil. Propane, butane or similar solvent is mixed with the contaminated oil to form a solution. This solution is agitated and then given time to settle thus allowing gravitational separation of asphaltic pollutants. The solution is then percolated through a columned filter to remove heavy metallic contaminants and the solvent recovered by heating the solution.

4 Claims, 2 Drawing Sheets

PROCESS FOR CONTAMINATED OIL RECLAMATION

This application is a divisional of application Ser. No. 07/522,642, filed May 14, 1990 now U.S. Pat. No. 5,286, 380.

BACKGROUND

1. Field of Invention

This invention relates generally to the reclamation of used fossil fuels and more specifically to an improved process and related apparatus for ridding contaminated motor oil of common pollutants.

2. Prior Art

A number of methods and processes for removing dirt and other performance inhibiting contaminants from motor oils are known in the art. One of the first of these processes is described in U.S. Pat. No. 2,196,989 awarded to Henry and Montgomery. The '989 patent discloses combining the oil to be treated with a light hydrocarbon solvent, such as propane, to form a two phase solution.

The first phase, a substantially oil/solvent solution phase, rises above the second phase, a substantially asphalt phase, because of the difference in specific gravities. One or more of a group of gases such as methane, ethane, hydrogen, carbon dioxide and nitrogen is then added to the first phase to act as a precipitant for the oil and further remove undesired components. The '989 patent shows a closed system, thus allowing for reuse of the solvent and gas.

However, while the process of the '989 patent appears somewhat effective in removing asphaltic materials from used oils, it disclosed no method for removing other environmentally dangerous contaminants therefrom, such as lead. Additionally, the '989 process appears to be effective only if used on a large scale.

A second relevant patent indicative of more modern developments in the prior art is U.S. Pat. No. 3,870,625 issued to Wielezynski. Therein is disclosed a method for cleaning lubricant oils comprising spraying the used oil in pulses into a column where propane is simultaneously introduced. After settling of unwanted material by gravity to the bottom of the column, the propane/oil solution is transferred to another column in which the process is repeated. A series of columns allows for multiple repetitions. Finally, the propane is separated from the oil for future use by vaporization of the former.

The '625 patent, similar to the '989 patent, discloses no method of removing lead and other metallic substances from the contaminated oil, thus severely limiting the scope of use of the regenerated oil. Also, the fact that several columns are utilized hinders the economic and efficient use of space.

BRIEF SUMMARY AND OBJECTS OF THE INVENTION

In brief summary, the present invention overcomes or substantially alleviates the aforementioned prior art problems by providing a novel process and related apparatus for removing contaminants such as dirt and lead from used motor oils. The preferred embodiment comprises the steps of manually mixing a contaminated motor oil with a liquified aliphatic solvent, such as acetone or butane, in approximately a 1 to 10 ratio, i.e. 10 parts solvent to 1 part oil; allowing time for gravitational settlement of precipitants in the solution; percolating said solution through an activated charcoal filter; and separating the regenerated oil from the solvent by vaporizing the latter.

A second preferred embodiment comprises the steps of filling a vessel with contaminated oil; heating and compressing an aliphatic, liquified hydrocarbon solvent; allowing said heated and compressed solvent to bubble up through the contaminated oil from the bottom of the vessel for a period of time; percolating the oil and solvent in solution from the vessel through an activated charcoal filter; and recovering the solvent from the regenerated oil by vaporizing the former.

Both of these embodiments of the invention are desirable and advantageous over the prior art in that they can be made as small or as large as space and economical consideration demand. Furthermore, the invention provides a method for removing lead and other metallic contaminants from the used oil not found in the prior art, thus allowing for its reuse in the function for which it was originally intended. For example, oil which has been used as a lubricant in an automotive engine can be used in that same capacity after treatment with the apparatus of this invention.

Also, bubbling heated and compressed solvent up through the contaminated oil allows improved, more efficient intermixing of those two components.

With the foregoing in mind, it is a primary object of this invention to provide an improved process, and related apparatus, for regenerating contaminated motor oils.

Another significant object is to provide an easily used, efficient, economical process for cleansing dirty motor oils.

A further significant object of the invention is to provide an improved method for intermixing used motor oil and an aliphatic solvent in the regeneration of said used motor oil.

Another important object is the provision of a method to substantially eliminate lead and other metallic contaminants from used motor oils.

These and other objects and features of the present invention will be apparent from the detailed description taken with reference to the accompanying drawings.

DETAILED DESCRIPTION OF THE ILLUSTRATED EMBODIMENTS

Figure 1:
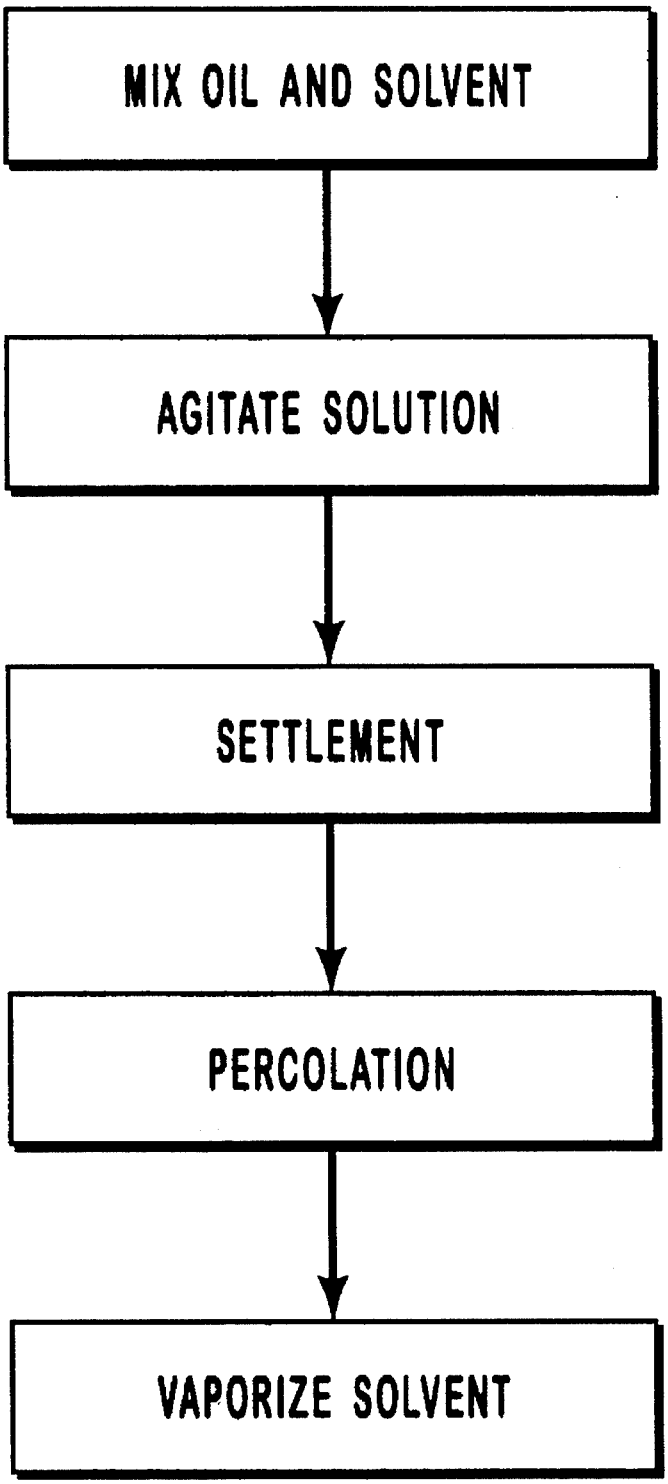
FIG. 1 is a block diagram showing the steps to a preferred process for cleaning used oil according to the present invention.

Reference is now made to the drawings, wherein like numerals are used to designate like parts throughout. One presently preferred embodiment of the process for regenerating used motor oil is illustrated in the block diagram in FIG. 1. The first step in this embodiment of the invention, as indicated, is to manually mix a certain volume of used and contaminated motor oil with a volume of liquid solvent such as acetone, isopropyl alcohol or a hydrocarbon from the methane series. A ratio of 10 parts solvent to 1 part oil gives the best results, although it is recognized that other concentrations are within the purview of this invention. The mixing is accomplished in an appropriately sized container capable of holding liquids. Glass or plastic is preferred.

The oil/solvent solution is then manually agitated, whether by shaking, stirring or some other method.

Following the agitation of the oil with the solvent, the solution formed is allowed to sit for a period of time. The time is determined by a number of factors, including contamination level of the oil, desired level of regeneration, batch size, and economic considerations. During this time period, sludge, dirt and other contaminants precipitate and settle to the bottom.

Next, the top layer of oil and solvent in solution are removed from the container and poured into the top end of a columned filter comprised of activated charcoal. This filter is commonly used in the cyanide process for absorbing gold, silver and other heavy metals. A second vessel is placed below the columned filter to catch the oil and solvent in solution after it percolates therethrough.

Following percolation through the columned filter, the solution is heated to separate the oil and solvent. The preferred solvents vaporize at a relatively low temperature, thus avoiding the dangers and expense of high heat. The vaporized solvent is gathered in a standard condenser and may be reused at a later time. The regenerated oil is at this point ready for reuse as an engine lubricant or any other desired function performed by unused oil.

Figure 2:
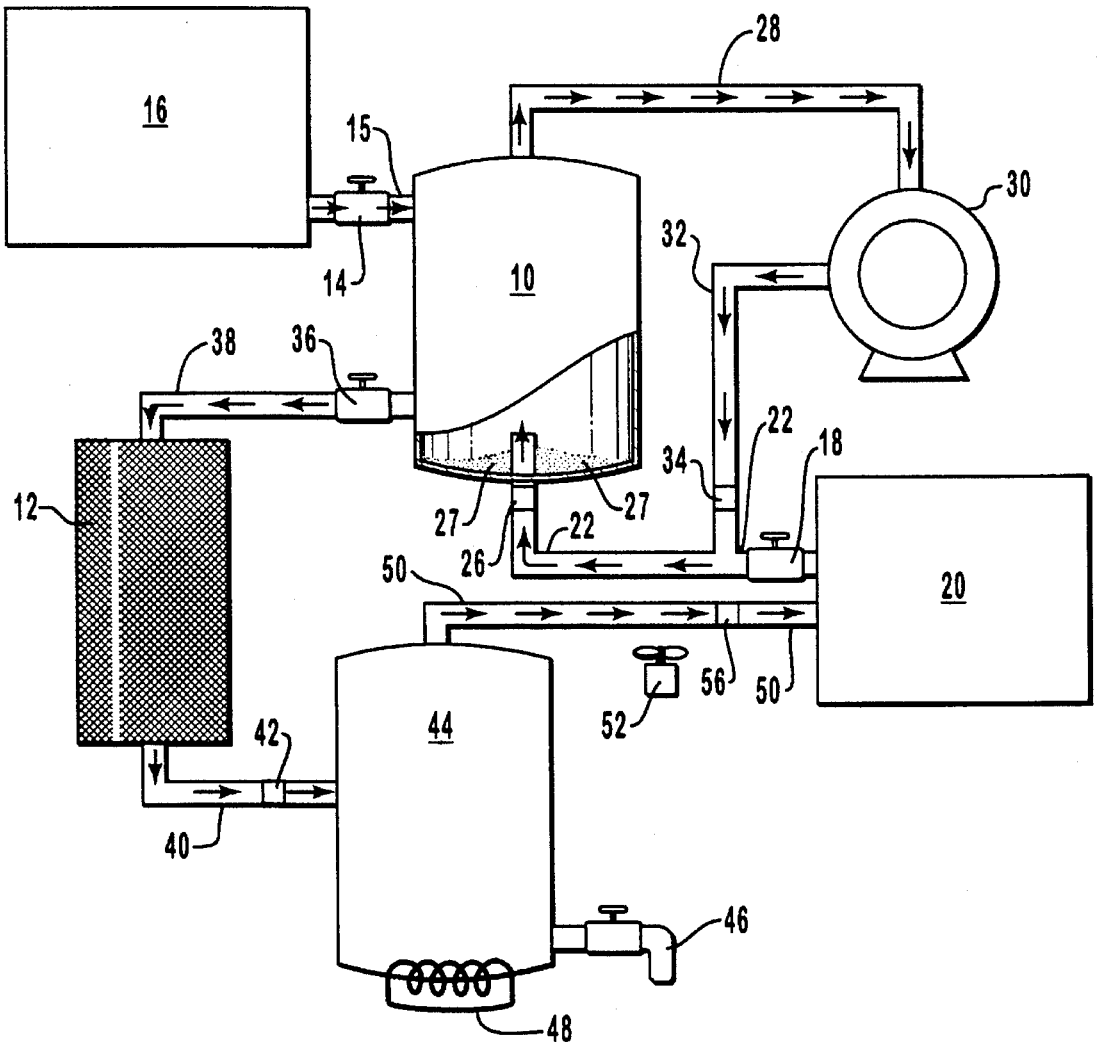
FIG. 2 is an illustration of an apparatus which employs a second preferred process of this invention to regenerate used motor oil.

A second embodiment of the invention is illustrated in FIG. 2. Therein a single reactor vessel 10 removes sludge and dirt from the oil, while a columned filter 12 of activated charcoal, described above, removes lead and other metallic contaminants. A single batch of regenerated motor oil is processed according to this embodiment as follows.

First, a valve 14 is opened to allow a certain volume of used oil into the reactor vessel 10 from a supply thereof 16, not shown, through line 15. Reactor vessel 10 is filled approximately one fourth full of oil. Valve 18 is then opened to allow a supply of liquid propane, or similar, to enter the system before being reclosed. A supply of propane is provided from a supply tank 20 which feeds valve 18 and vessel 10 through line 22.

The liquid propane bubbles up through the oil, precipitating dirt and sludge 27 which sink to the bottom of vessel 10 and accumulate. A line 28 exits the top of vessel and allows escape of propane gas therefrom. Line 28 leads the propane gas to a compressor 30 which has been actuated and wherein the propane is compressed back into a liquid state and heated. Another line 32 exits the compressor 30 returning the liquid propane back to line 22 for reentry into vessel 10. A one way valve 34 prevents back flow of the propane into the compressor 30.

The propane is allowed to circulate through vessel 10 in this manner for several minutes. The compressor 30 is then turned off and another valve 36 is opened. Valve 36 is situated in a line 38 leading from the vessel 10 to the top portion of the columned filter 12. The oil and propane solution is allowed to percolate down through the columned filter 12 and is then collected into a line 40 situated at the bottom portion thereof. Line 40 carries the demetallized oil and solvent from the bottom portion of the columned filter 12 into another vessel 44. A one way valve 42 prevents backflow into line 40 from the vessel 44.

The oil and propane solution is then heated by standard heating element 48 to separate the regenerated oil from the propane. Vaporized propane rises to the top of the vessel 44 and exits therefrom through line 50, which returns the propane to supply tank 20 for reuse. As the propane passes through line 50, it is cooled preferably by a fan 52 into a liquid before entering supply tank 20. A one way valve 56 prevents backflow of the propane into the line 50.

After separation and removal of the propane in the vessel 44, the regenerated oil is left to empty through another valve 46.

The process is repeated as desired. The oil removed from the vessel 44 is environmentally safe having been stripped of all sludge, dirt, metals and other contaminants, and is suitable for reuse in any capacity to which fresh unused oil may be applied.

This invention may be embodied in other specific forms without departure from the spirit or essential characteristics thereof. The present embodiments, therefore, are to be considered in all respects illustrative and not restrictive, the scope of the invention being defined by the appended claims rather than the foregoing description, and all changes which come from within the meaning and range of equivalence of the claims are therefore to be embraced therein.

What is claimed and desired to be secured by United States Letters Patent is:

1. A process for reclaiming contaminated motor oil comprising the steps of:

(a) combining contaminated motor oil with an aliphatic solvent in a ratio of between five parts of said aliphatic solvent to one part of said contaminated motor oil and fifteen parts of said aliphatic solvent to one part of said contaminated motor oil to form a solution in a first reaction vessel having top and bottom ends;

(b) agitating said solution by allowing heated liquid solvent to bubble up through said solution, said heated liquid solvent being introduced through the bottom end of the first reaction vessel;

(c) allowing said solution to settle gravitationally;

(d) percolating said solution through a filter; and (e) recovering said aliphatic solvent for reuse.

2. A process for reclaiming contaminated motor oil according to claim 1.

3. A process for reclaiming contaminated motor oil according to claim 1 wherein said step of recovering said aliphatic solvent is accomplished by vaporization.

4. A process for reclaiming contaminated motor oil according to claim 1 wherein said aliphatic solvent is selected from the group consisting of methane, ethane, propane, butane, pentane, hexane, heptane, acetone and isopropyl alcohol.

* * * * *